US010794108B1

(12) United States Patent
Dodds

(10) Patent No.: US 10,794,108 B1
(45) Date of Patent: Oct. 6, 2020

(54) BI-FOLD DOOR PIN BRACE

(71) Applicant: Robert J. Dodds, Rosemount, MN (US)

(72) Inventor: Robert J. Dodds, Rosemount, MN (US)

( * ) Notice: Subject to any disclaimer, the term of this patent is extended or adjusted under 35 U.S.C. 154(b) by 0 days.

(21) Appl. No.: 15/947,812

(22) Filed: Apr. 7, 2018

Related U.S. Application Data

(63) Continuation-in-part of application No. 15/592,169, filed on May 10, 2017, now Pat. No. 10,604,982.

(60) Provisional application No. 62/482,729, filed on Apr. 7, 2017, provisional application No. 62/349,946, filed on Jun. 14, 2016, provisional application No. 62/336,912, filed on May 16, 2016, provisional application No. 62/334,217, filed on May 10, 2016.

(51) Int. Cl.
*E06B 3/00* (2006.01)
*E06B 3/48* (2006.01)
*E05D 15/26* (2006.01)

(52) U.S. Cl.
CPC ..... *E06B 3/481* (2013.01); *E05D 15/264* (2013.01)

(58) Field of Classification Search
CPC ..... E06B 3/481; E05F 5/06
See application file for complete search history.

(56) References Cited

U.S. PATENT DOCUMENTS 1,361,913 A 12/1920 Sebastian
1,934,299 A 11/1933 Fairhurst
2,842,795 A 7/1958 Majeske
2,882,962 A * 4/1959 Hollansworth ..... E05D 15/266 160/118
2,987,756 A 6/1961 Hollansworth
3,054,447 A * 9/1962 Brydolf ..... E05D 15/266 160/206
3,066,730 A 12/1962 Schwartzberg
3,096,539 A * 7/1963 Dickinson ..... E05D 15/266 16/259
3,102,582 A * 9/1963 Rudnick ..... E05D 15/266 160/206
3,144,077 A 8/1964 Dickinson et al.
3,187,800 A * 6/1965 Kirby ..... E05D 7/0027 160/206
3,191,214 A * 6/1965 Protzman ..... E05D 7/0027 16/87 R
3,221,804 A 12/1965 Rudnick
3,246,684 A 4/1966 Rudnick
3,251,089 A 5/1966 Fergison
(Continued)

*Primary Examiner* — Alvin C Chin-Shue
(74) *Attorney, Agent, or Firm* — Albert W. Watkins

(57) ABSTRACT

A bi-fold door pin brace braces the exposed shafts of bi-fold door pins against the force exerted on the pin assemblies by door movement out of alignment with the track. The bi-fold door pin brace has a header mounting plate generally defines a generally planar surface and is configured to mount into a door header, ceiling, or the like. A coupling plate extends from the header mounting plate in a plane angularly offset therefrom. A bi-fold pin shaft bracing plate defines a third generally planar surface that extends from the coupling plate in a plane generally parallel to the header mounting plate. The bi-fold pin shaft bracing plate is configured to engage with and provide support to a bi-fold pin shaft, and can be used in conjunction with or as part of an assembly with a bi-fold door stop.

14 Claims, 6 Drawing Sheets

(56) References Cited

U.S. PATENT DOCUMENTS

| | | | | | |
|---|---|---|---|---|---|
| 3,335,785 | A * | 8/1967 | Anderson | E05D 15/266 | 160/206 |
| 3,400,749 | A | 9/1968 | Smith | | |
| 3,536,120 | A | 10/1970 | Kellems | | |
| 3,554,267 | A | 1/1971 | Brinker | | |
| 3,583,464 | A * | 6/1971 | Johnson, Jr. | E05D 15/264 | 160/206 |
| 3,662,808 | A * | 5/1972 | Edeus | E05D 15/266 | 160/206 |
| 3,907,021 | A | 9/1975 | Smith | | |
| 3,957,102 | A * | 5/1976 | Kempel | E05D 15/266 | 160/206 |
| 3,987,837 | A | 10/1976 | Hewson | | |
| 4,644,992 | A | 2/1987 | Jerila | | |
| 5,080,160 | A * | 1/1992 | Gephart | E05D 15/266 | 16/94 R |
| 5,085,261 | A | 2/1992 | Bortoluzzi | | |
| 5,085,262 | A | 2/1992 | Tutikawa | | |
| 5,186,230 | A | 2/1993 | Ostrander | | |
| 6,418,590 | B1 * | 7/2002 | Nipper | E05D 15/264 | 16/229 |
| 6,438,795 | B1 | 8/2002 | Haab et al. | | |
| 7,258,153 | B2 | 8/2007 | Chen | | |
| 2006/0231218 | A1 * | 10/2006 | Liang | E05D 15/26 | 160/206 |

* cited by examiner

Fig. 8
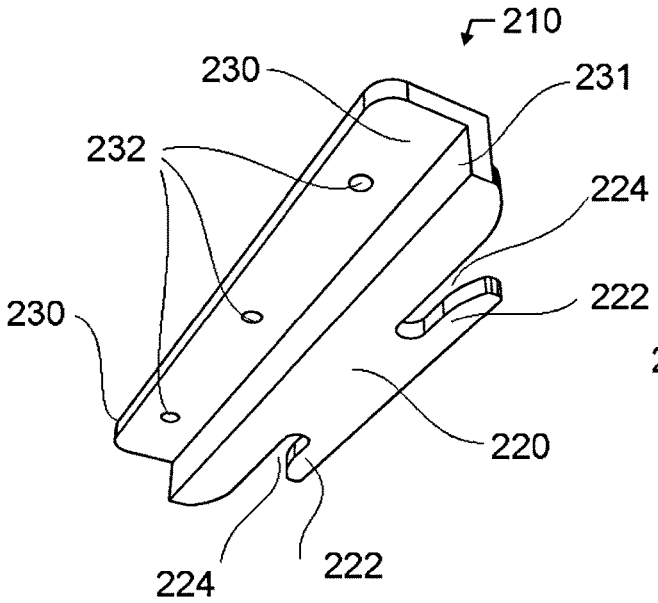
Fig. 9
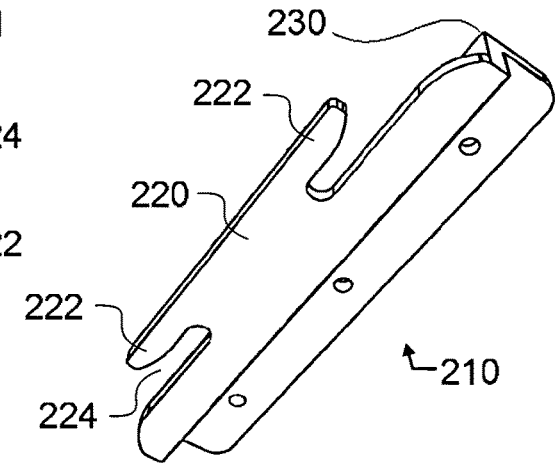
Fig. 10
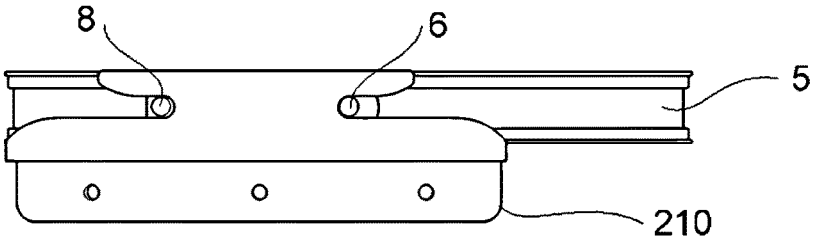
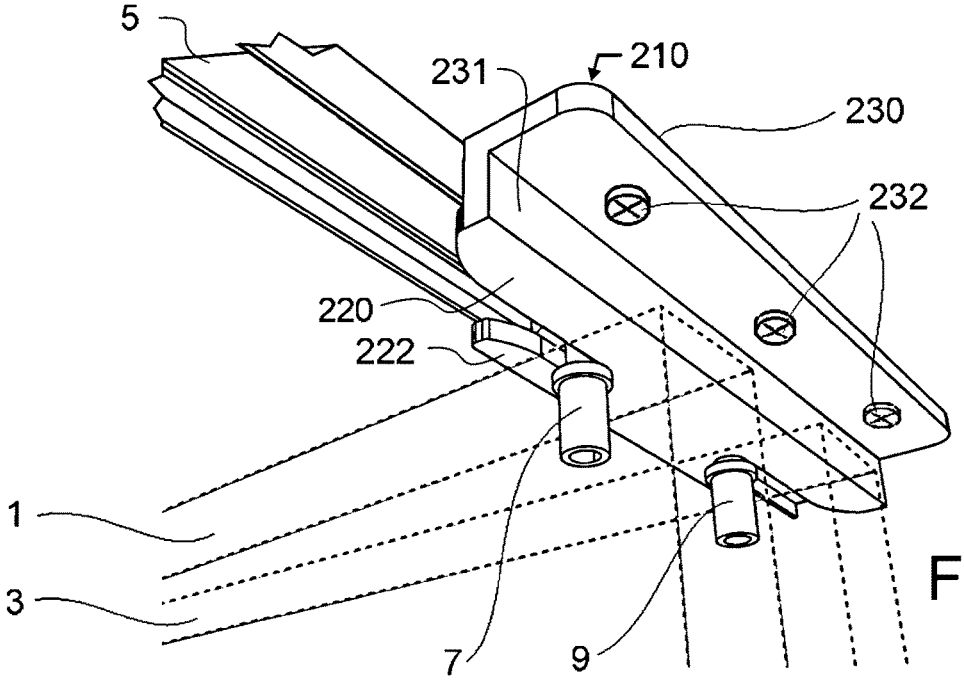
Fig. 11

Fig. 12
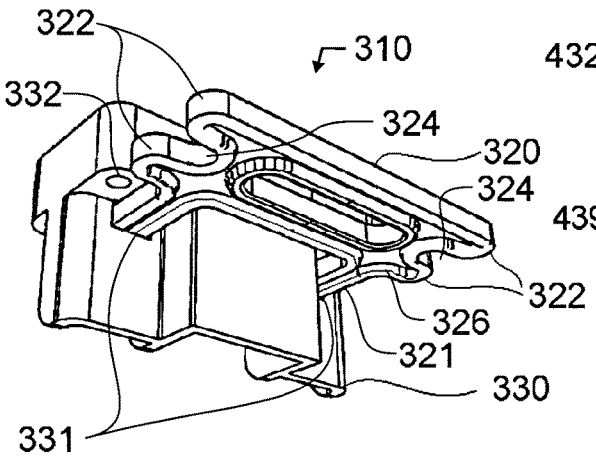
Fig. 13
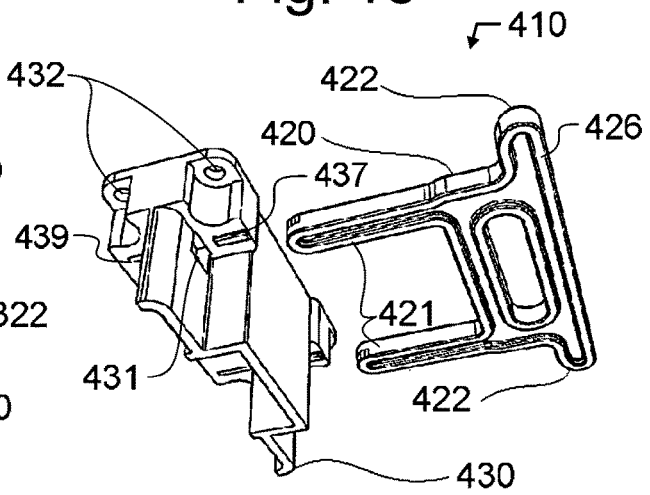
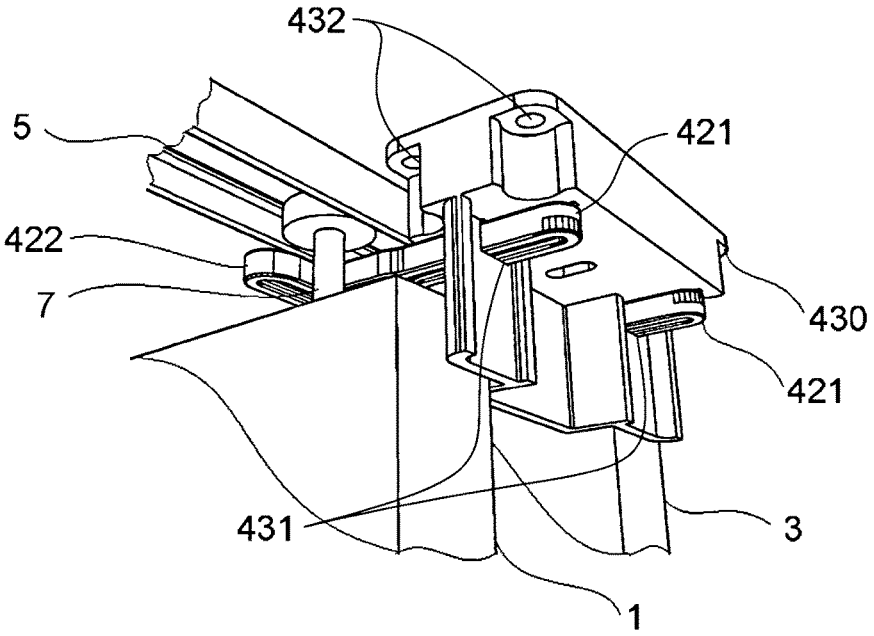
Fig. 14

Fig. 15
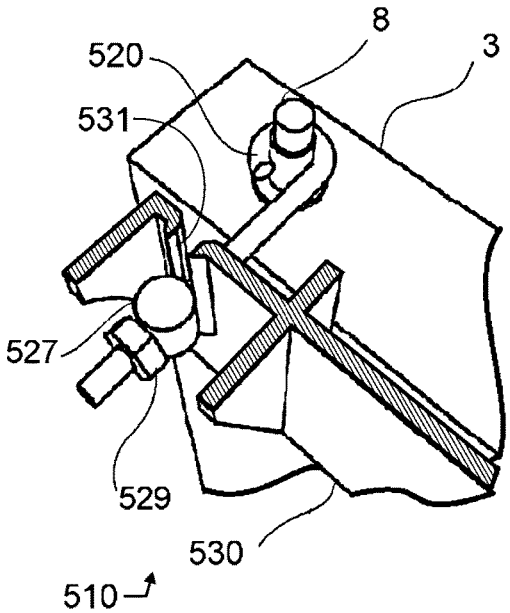
Fig. 16
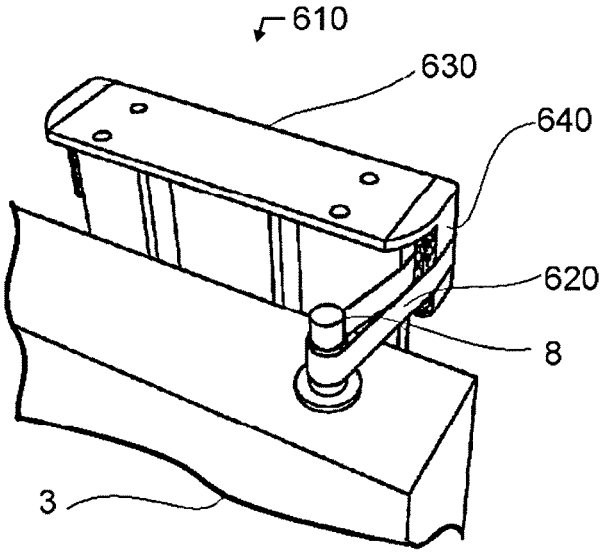
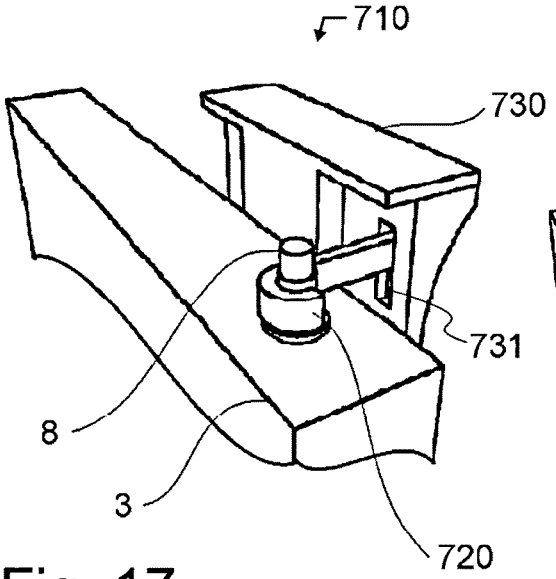
Fig. 17
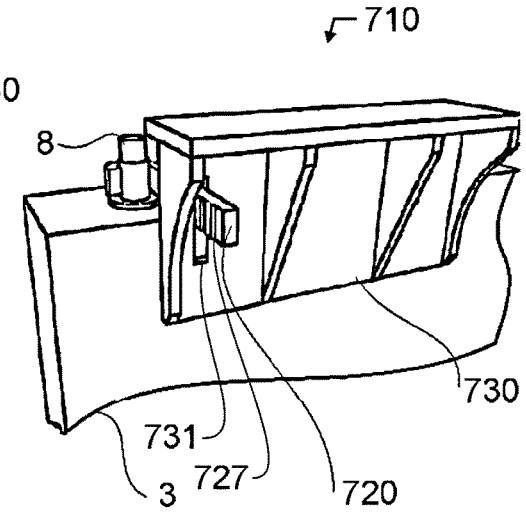
Fig. 18

BI-FOLD DOOR PIN BRACE

CROSS REFERENCE TO RELATED APPLICATIONS

The present application claims the benefit of U.S. provisional patent application 62/482,729 filed Apr. 7, 2017 of like title and inventorship; and is a Continuation-In-Part of U.S. patent application Ser. No. 15/592,169 filed May 10, 2017, which in turn claims the benefit of U.S. provisional patent applications 62/334,217 filed May 10, 2016; 62/336,912 filed May 16, 2016; and 62/349,946 filed Jun. 14, 2016; each of like inventorship, the teachings and entire contents of all which are incorporated herein by reference.

BACKGROUND OF THE INVENTION

1. Field of the Invention

This invention relates generally to vertically hung, track guided, pivotally folded doors of the type commonly used for closets, commonly known as bi-fold or bifold doors, and more particularly to braces for door pins operative in combination with bifold doors.

2. Description of the Related Art

When a person requires storage, whether it be for clothing, linens, supplies, or for any other storage purpose, it is desirable to have good visual access to the items being stored. This allows a person to readily store and retrieve more items, with much less effort. In order to do so, this storage space can, for exemplary purposes, be in the form of a walk-in closet. However, such closets require a substantial amount of square footage, since the storage space must not only be large enough for the things being stored, but also for the person storing and retrieving the merchandise to be physically completely inside the storage space. Consequently, for many closets, pantries, and the like, few people choose a walk-in space.

In contrast, for exemplary and non-limiting purposes, a long and relatively shallower closet than runs along a pre-existing walk space does not require any extra space for the person, substantially reducing wasted space. However, since this is a walkway or space used for other purposes, it is very desirable that the door into the storage space not block the walkway or area adjacent to the storage space entry. Unfortunately, single panel doors such as are commonly used as entry doors into bedrooms and the like must be of width equal to the width of the opening. So, for a storage space to have 32" of directly accessible width, a door that is at least close to the 32" width is required. This means that the door will swing into the walkway, creating a hazard. Furthermore, for wider storage spaces, which as noted above is desirable, the size of the door becomes unwieldy or even impractical or impossible. Instead, some closet spaces are closed by two doors, each having an outside hinge, that swing together to close the storage area. This allows essentially twice the directly accessible storage space without having to enter the storage area, but still involves large doors that either pivot entirely out into the walkway or entirely into the closet, in either case interfering with and potentially blocking the closet or the walkway.

Recognizing the limitations of these single panel doors, many artisans have devised or improved upon a multi-panel arrangement referred to as a bi-fold door. A typical vertically hung bi-fold door is comprised of two half-doors that are connected together by hinges; the pivot door and lead door. The pivot door is mounted to the finished opening by a spring loaded top pivot pin inserted into a pivot bracket mounted within a track, and an adjustable height bottom pivot pin is inserted into a bottom pivot bracket at the base of the door jamb. The pivots support the entire weight of both doors. The lead door is connected to the pivot door by hinges. On the upper corner of the lead door is a guide pin assembly. This assembly is comprised of a wheel, roller, slider, or the like mounted to a spring-loaded shaft that is installed into a hole on the edge of the door. The guide pin slider runs in the bi-fold track that is mounted to the header of the doorway. The track guides the lead door pin throughout the travel distance and keeps the doors in a tight path, out of the walkway or other space. Consequently, the opening is divided into smaller panels that fold up in pairs and stack neatly against the edges of the opening when the door is opened, and which slide out and close the storage entry when closed. The bi-fold door is a particularly pervasive design, owing to the economical construction and installation of the doors, tremendous accessibility to storage space, and minimal space required by the doors when fully open and when being opened.

The spring-loaded pins are provided to accommodate variable door opening heights. Since construction variances or tolerances can lead to differing opening heights, provision must be made to accommodate the expected variances. The springs achieve this desired adaptability.

Exemplary U.S. patents showing various bi-fold doors and related hardware, the teachings which are incorporated herein by reference, include: U.S. Pat. No. 1,361,913 by Sebastian, entitled "Casement window"; U.S. Pat. No. 1,934,299 by Fairhurst, entitled "Folding partition"; U.S. Pat. No. 2,842,795 by Majeske, entitled "Adjustable pivot for door track"; U.S. Pat. No. 3,066,730 by Schwartzberg, entitled "Combination folding door and guide means therefor"; U.S. Pat. No. 3,400,749 by Smith, entitled "Bifold door handle"; U.S. Pat. No. 3,554,267 by Brinker, entitled "Folding doors"; U.S. Pat. No. 3,907,021 by Smith, entitled "Alignment and retention hardware for folding doors"; U.S. Pat. No. 4,644,992 by Jerila, entitled "Pivot block for bifold doors"; U.S. Pat. No. 5,085,261 by Bortoluzzi, entitled "Longitudinally sliding accordion door"; U.S. Pat. No. 5,085,262 by Tutikawa, entitled "Device for supporting folding doors"; and U.S. Pat. No. 5,186,230 by Ostrander, entitled "Mechanism for operating bi-fold doors".

Unfortunately, there are deficiencies in the design, manufacture, or installation of bi-fold doors which can lead to excessive wear and damage to the doors, track and components. When a person fully opens a bi-fold door, the lead door and pivot door are nearly parallel to each other and at a near perpendicular angle to the rail. In order to close the door, a person grasps onto the door knob that is mounted onto the lead door and pulls the door all the way until the bi-fold door closes flat, generally parallel to the rail. When a person attempts to close the bi-fold doors, both of the lead and pivot doors can slightly rotate around the pivot pin, towards the pulling force. When this occurs, the guide pin will stick or bind in the bi-fold track due to force being applied to the pivot pin being at a great angle to the path of the track.

When the doors are starting to close, there is a moment in which the lead door guide pin roller can bind or jam in track. This can occur when a person pulls on the door with either too much force or from a poor angle so that the door hinges are shifted towards the direction of travel and are ahead of the guide wheel. This causes an acute angle to form between the lead door and bi-fold door track on the closing side. In order for the doors to close, the hinge must be shifted back toward the door pivot so that the hinges follow behind the guide wheel. Once a sufficient angle is achieved between lead door and closet rail, the guide wheel will move freely and the pivot door will follow the lead door until the door is finally closed.

When the lead guide pin roller is jammed in the track, the person must stop pulling the door in order to reposition the doors, or redirect the angle of the pulling action. Repeated binding of the guide pin roller in the track can cause the track to deform, exasperating the problem. When the roller binds in the track, the leverage exerted on the guide pin shaft will damage the guide pin and the mounting hole in the door.

As noted above, the guide pin and pivot pin are spring loaded in order to facilitate installation of the door. As such, the wheel guide and pivots have considerable play in their movement.

In order to terminate the opening travel of the lead door guide pin, skilled artisans have proposed stops incorporated into the top pivot bracket. Exemplary U.S. patents, the teachings which are incorporated herein by reference, include: U.S. Pat. No. 2,882,962 by Hollansworth, entitled "Folding doors"; U.S. Pat. No. 2,987,756 by Hollansworth, entitled "Adjustable retainer for folding door pivot pin"; U.S. Pat. No. 3,096,539 by Dickinson et al, entitled "Folding door hinge assembly"; U.S. Pat. No. 3,144,077 by Dickinson et al, entitled "Folding door controlling hardware"; U.S. Pat. No. 3,187,800 by Kirby, entitled "Folding door mounting structure"; U.S. Pat. No. 3,221,804 by Rudnick, entitled "Folding door structure and assembly"; U.S. Pat. No. 3,246,684 by Rudnick, entitled "Hinge structure"; U.S. Pat. No. 3,251,089 by Fergison, entitled "Hinge assembly"; U.S. Pat. No. 3,536,120 by Kellems, entitled "Folding door installation and sliding guide therefor"; U.S. Pat. No. 3,987,837 by Hewson, entitled "Bi-fold door assembly"; U.S. Pat. No. 5,080,160 by Gephart et al, entitled "Track and pivot bracket for bi-fold doors"; U.S. Pat. No. 6,438,795 by Haab et al, entitled "Buffer device"; and U.S. Pat. No. 7,258,153 by Chen, entitled "Auto-reversible folding door".

Unfortunately, a common problem with stops is that when the guide wheel assembly impacts the stopper, considerable force is applied to the guide pin shaft and the mounting hole in the lead door. There are several compounding factors that lead to increased damage.

A first compounding factor is the relatively long lever arm created by the pivot pin protruding from the door. Torque is measured by the product of force and distance from the anchor point. So, for exemplary purposes, a twenty pound force applied one inch from an anchor creates twenty inch pounds of force. However, to generate the same amount of torque using a force applied only one-half inch from the anchor would require a forty pound force. As may be appreciated then, bringing the force closer to the anchor can greatly reduce the likelihood of damage.

A second compounding factor is that the stop still relies upon the track to provide the anchor. While these prior art stops do tend to distribute the force better across more of the track, which is unquestionably highly beneficial, ultimately if the track is fabricated from relatively thin and lightweight material, then this may not be sufficient to protect the track from damage. Noteworthy here is that the stresses will shift with these prior art anchors from the point of contact with the guide wheel to the leading and trailing edges of the stop, and also very importantly, to the ceiling anchors where there is no reinforcement.

Unfortunately, over time the resultant wear and damage to the track, guide pin components, and deformation of the pin mounting hole in the door compounds the problem of the lead door guide pin roller binding in the track when the door is closed. Repeated impacts drive the pivot bracket along the track until it meets the jamb wall. With the pivot bracket in this position, there is no clearance for the pivot door to rotate when the doors are closed. This results in damage to the jamb wall, the door panel, the pivot pin and the track.

Some of these aforementioned patents provide various means to cushion the impact, and reduce the likelihood of damage. While these cushioned stoppers are generally beneficial to the life of bi-fold door hardware, these still fail to address the application of substantial forces perpendicular to or angularly offset from the track, and to the potential inherently weak or flimsy track.

However, at least one artisan has attempted to address both problems. U.S. Pat. No. 3,102,582 by Rudnick, entitled "Folding door structure", the teachings which are incorporated herein by reference, discloses a stop that provides a header-anchored attachment that helps to control the door hardware when forces are applied that are not parallel to the track longitudinal axis. Unfortunately, this Rudnick invention requires a door with a groove cut in the header, which has not been the standard hardware for more than fifty years. Rudnick also provides only minimal reduction in the amount of torque applied to the pins, since the support is affixed on major surface against the door header.

As may be apparent, in spite of the enormous advancements and substantial research and development that has been conducted, there still remains a need for a bi-fold door stop apparatus that addresses the aforementioned deficiencies that are known to exist in the prior art.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

Exemplary embodiments of the present invention solve inadequacies of the prior art by providing a bracket, or an extension of a bracket, to brace the exposed shafts of bi-fold door pins against the force exerted on the pin assemblies by door movement relative to the track and pivot bracket, other than needed for door function. The bracket reduces the leverage exerted on the pin assemblies, track and other hardware during such undesired door movements, and during proper operation.

The pin brace is designed to brace the shaft of the pin assemblies in several situations. In prior art bifold door assemblies, the shafts of both the guide pin and the pivot pin have been free to move up and down to allow for compression during door installation, and to absorb variations in the distance between the door panels and the track during operation. The resultant extension of the pin shaft forms a lever arm that causes damage to the door panels, the pin assembly, the shaft itself, the pivot bracket, and the track, both during normal operation, and especially in the situations of over rotation of the door assembly when attempting to close the door, and when excessive force is used to open the door.

When an attempt to close the door has caused the hinges to move ahead relative to the guide pin, this results in a lateral movement of the guide pin in the track. The pin brace will reduce the length of the lever arm created in this situation, by bracing the exposed shafts of both the guide and pivot pin assemblies. This also restricts the angle that the pins can be forced into, which might otherwise bend the pin shaft or enlarge the pin mounting holes in the doors. The present pin brace prevents the pins to be forced to unnatural angle, which means the braced guide pin slider or wheel can no longer move laterally. Lateral movement would undesirably bend the side wall of the track. The present pin brace also prevents the pivot pin from moving laterally. Lateral movement would undesirably dislodge the pivot bracket and bend the track.

If the door is fully opened in a forceful manner, the pin brace will terminate the movement of the guide pin by impeding the path of the guide pin shaft. Without the pin brace, the movement is normally terminated by the guide pin wheel or slider impacting a stop in the track. Since the pin brace is operating on the pin shaft closer to the door, the present pin brace again reduces the leverage on the guide pin assembly. Also in this situation, when the guide pin movement is terminated, it creates a pivot point for the door assembly to rotate around, causing the pivot pin to move laterally to the track. This can dislodge the pivot bracket and distort the track wall. The pin brace reduces the leverage applied to the pivot pin when the door is closed and reaches the end of its travel.

The present invention can be used in conjunction with, or as part of an assembly with the bi-fold door stop described in U.S. provisional patent application 62/349,949 filed Jun. 14, 2016 and also described in U.S. patent application Ser. No. 15/592,169 filed May 10, 2017, each by the present inventor and incorporated by reference herein above. In such case, the pin brace restrains the pivot pin when the door assembly becomes jammed when closing the door. In this situation, the side edge of the lead door is restrained by the bi-fold door stop, creating a new pivot point for the door assembly. The pivot pin is pulled in a lateral direction to the track by the door assembly, and unless restrained by the pin brace, would dislodge the pivot bracket, and bend the track side wall. In the case of the door being opened forcefully, the lead door panel travel is terminated by the bi-fold door stop, creating a pivot point for the door assembly. The rotation of the door assembly now causes the pivot door to move laterally until the side edge is restrained by the bi-fold door stop. This becomes the new pivot point for the door assembly. The continued rotation of the door assembly would then cause the guide pin to be pulled laterally outward, bending the track side wall. Instead, the present pin brace restrains the lateral movement of the guide pin, preventing damage to the track.

In a first manifestation, the invention is, in combination, a bi-fold door and a bi-fold door pin brace operative to safely limit the movement of the bi-fold door. The bi-fold door has a bi-fold door track; a lead door; a guide pin affixed to the lead door and configured to slide within the bi-fold door track; a pivot door; a pivot pin anchored with respect to the bi-fold door track and affixed to the pivot door; and a hinge coupling the lead door to the pivot door. At least of the lead door and pivot door have a door stile. The bi-fold door pin brace has a header mounting plate generally defining a first generally planar surface; a coupling plate extending from the header mounting plate in a plane angularly offset therefrom; and a bi-fold pin shaft bracing plate defining a third generally planar surface extending from the coupling plate in a plane offset from the coupling plate plane and generally parallel to the header mounting plate first generally planar surface. The bi-fold pin shaft bracing plate is configured to engage with and provide support to a bi-fold pin shaft.

In a second manifestation, the invention is a bi-fold door pin brace, having a header mounting plate generally defining a first generally planar surface; a coupling plate extending from the header mounting plate in a plane angularly offset therefrom; and a bi-fold pin shaft bracing plate defining a third generally planar surface extending from the coupling plate in a plane offset from the coupling plate plane and generally parallel to the header mounting plate first generally planar surface. The bi-fold pin shaft bracing plate is configured to engage with and provide support to a bi-fold pin shaft.

In a third manifestation, the invention is, in combination, a bi-fold door, a bi-fold door stop operative to safely limit the movement of the bi-fold door, and a bi-fold door pin brace. The bi-fold door has a bi-fold door track; a lead door; a guide pin affixed to the lead door and configured to slide within the bi-fold door track; a pivot door; a pivot pin anchored with respect to the bi-fold door track and affixed to the pivot door; and a hinge coupling the lead door to the pivot door. At least of the lead door and pivot door have a door stile. The bi-fold door stop has a first bi-fold door stile stop configured to engage with and thereby limit travel of the door stile in a first travel direction; and a second bi-fold door stile stop configured to engage with and thereby limit travel of the door stile in a second travel direction generally perpendicular to the first travel direction. The bi-fold door pin brace has a coupler affixing the bi-fold door pin brace to the bi-fold door stop; and a bi-fold pin shaft bracing plate configured to engage with and provide support to a shaft of at least one of the bi-fold door guide pin and bi-fold door pivot pin.

OBJECTS OF THE INVENTION

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to brace bi-fold door pins and thereby reduce the likelihood of harm or damage to the pins, the track, and the door panels. A second object of the invention is to anchor the pin brace directly to the header or ceiling, to increase the overall strength of the bi-fold door hardware. Another object of the present invention is to provide a pin brace that immediately abuts the track, and so provides reinforcement to the track when forces are applied to the track in a lateral direction. A further object of the invention is to enable the pin brace to be vertically adjustable to accommodate variations in the vertical position of the installed door panels, and thereby reduce the amount of torque applied to the pins and door panels. Yet another object of the present invention is to provide a pin brace that is intuitive and easy to install, without requiring any changes or alterations to the bifold door or door hardware, and which may be installed quickly with ordinary tools.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 8 illustrates a second alternative embodiment bi-fold door pin brace designed in accord with the teachings of the present invention from a bottom and back projected view.

FIG. 9 illustrates the second alternative embodiment bi-fold door pin brace of FIG. 8 from a bottom and front projected view.

FIG. 10 illustrates the second alternative embodiment bi-fold door pin brace of FIG. 8 from a bottom plan view, in further combination with a prior art track and pin assemblies sectioned through the pin shafts for illustrative purposes.

FIG. 11 illustrates the second alternative embodiment bi-fold door pin brace of FIG. 8 from a bottom and back projected view, in further combination with a prior art track, pin assemblies, and bi-fold doors.

FIG. 12 illustrates a third alternative embodiment bi-fold door pin brace designed in accord with the teachings of the present invention from a bottom and front projected view.

FIG. 13 illustrates a fourth alternative embodiment bi-fold door pin brace designed in accord with the teachings of the present invention from a bottom and front projected and exploded view.

FIG. 14 illustrates the fourth alternative embodiment bi-fold door pin brace of FIG. 13 from a bottom and back projected view, in further combination with a prior art track, pin assemblies, and bi-fold doors.

FIG. 15 illustrates a fifth alternative embodiment bi-fold door pin brace designed in accord with the teachings of the present invention from a top and back projected view with the header mounting plate sectioned by a horizontal plane.

FIG. 16 illustrates a sixth alternative embodiment bi-fold door pin brace designed in accord with the teachings of the present invention from a top and front projected view.

FIG. 17 illustrates a seventh alternative embodiment bi-fold door pin brace designed in accord with the teachings of the present invention from a top and front projected view.

FIG. 18 illustrates the seventh alternative embodiment bi-fold door pin brace of FIG. 17 from a back and side projected view.

DESCRIPTION OF THE PREFERRED EMBODIMENT

Manifested in the preferred and alternative embodiments, the present invention provides a bi-fold door pin brace that anchors directly to the door header, abuts the track, and braces bifold door pins to reduce the likelihood of harm or damage to the pins, the track, and the door panels.

Figure 1:
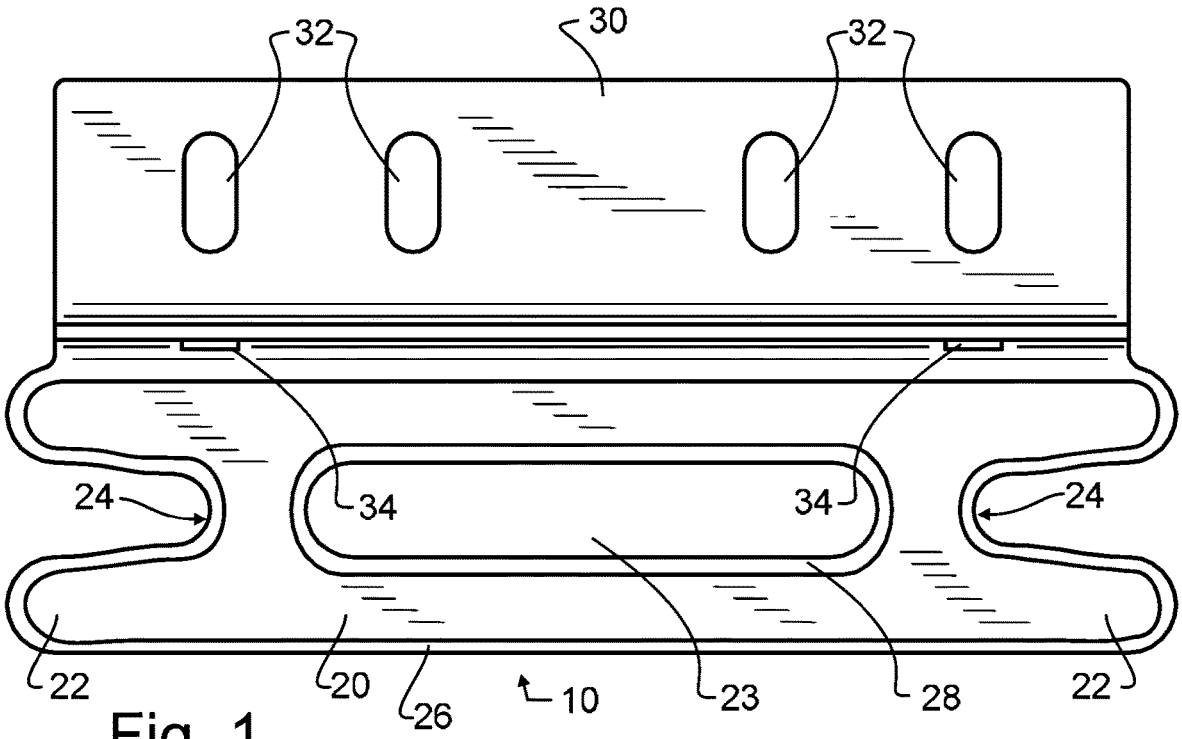
FIG. 1 illustrates a preferred embodiment bi-fold door pin brace designed in accord with the teachings of the present invention from a top plan view.
Figure 2:
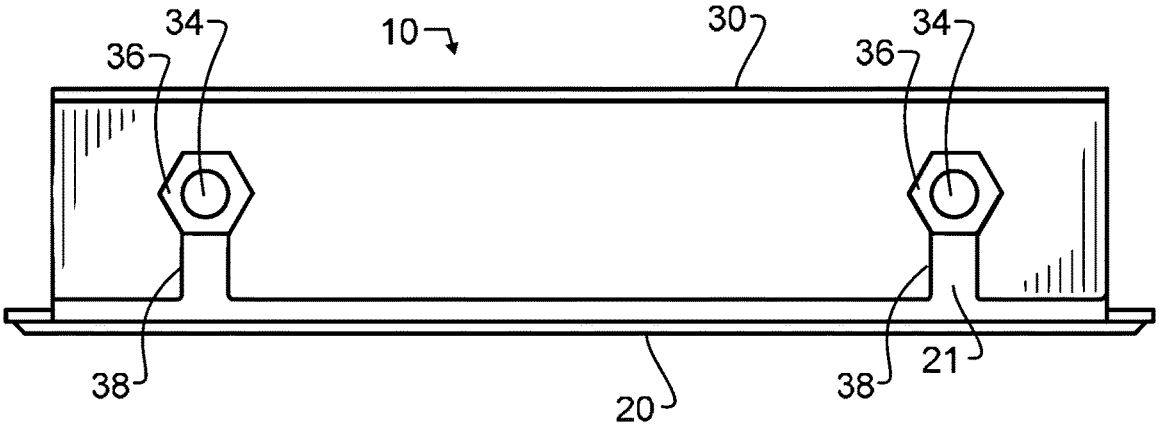
FIG. 2 illustrates the preferred embodiment bi-fold door pin brace of FIG. 1 from a back elevational view.
Figure 3:
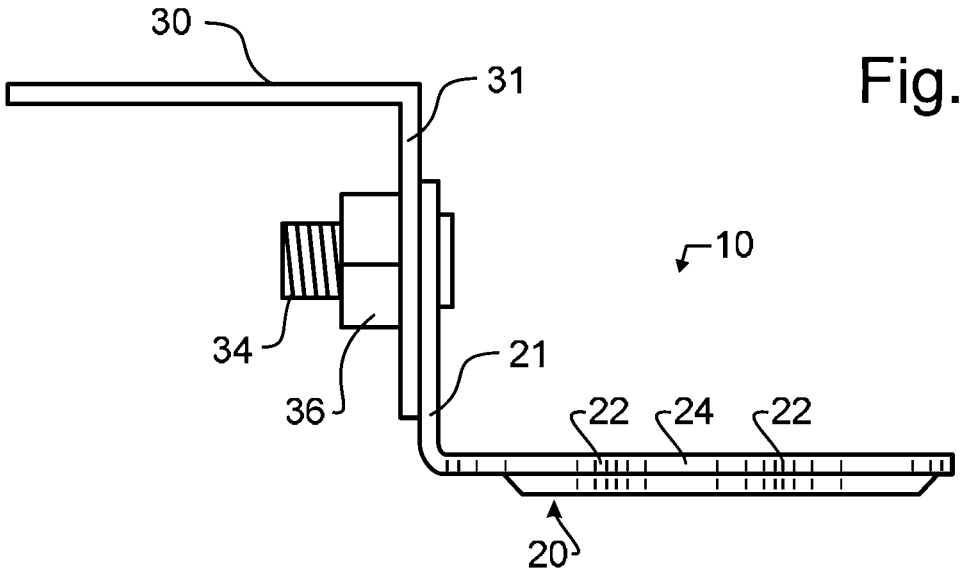
FIG. 3 illustrates the preferred embodiment bi-fold door pin brace of FIG. 1 from a side elevational view.
Figure 6:
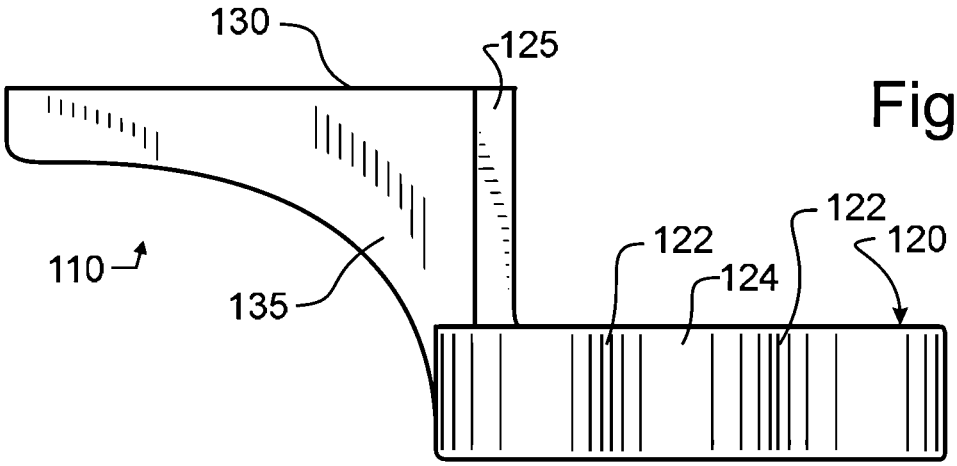
FIG. 6 illustrates the first alternative embodiment bi-fold door pin brace of FIG. 4 from a side elevational view.

In accord with the teachings of the present invention, FIGS. 1-3 illustrate a preferred embodiment bi-fold door pin brace 10. A shaft bracing plate 20 provides the primary bracing support for the pin shafts of prior art guide pin assemblies and pivot pin assemblies. A header mounting plate 30 anchors preferred embodiment bi-fold door pin brace 10 to a door header, ceiling, or other suitable structure. While not solely limited thereto, header mounting plate 30 will typically be separately and securely mounted to the same structure that the bi-fold track is mounted to.

Shaft bracing plate 20 has a pair of distally located bifurcated ends 22 that each define a shaft-receiving slot 24. Shaft bracing plate 20 is preferably coupled to header mounting plate 30 through an adjustable coupling, which permits shaft bracing plate 20 to be adjusted to be located just above the top edge of a lead door panel and a pivot door panel when the lead and pivot door panels are most nearly parallel to each other, as occurs in the most open position of a bi-fold door. While any suitable apparatus may be provided to enable such adjustment, for exemplary and non-limiting purpose in preferred embodiment bi-fold door pin brace 10 a coupling plate 21 is provided that extends from an edge of and in a plane generally perpendicular to shaft bracing plate 20. This angular offset between the two plates provides substantial strength for a given thickness of material. A similar coupling plate 31 extends in a plane at an angular offset from a plane defined by header mounting plate 30, thereby providing similar structural reinforcement.

In preferred embodiment bi-fold door pin brace 10 these two coupling plates 21, 31 are abutted together in adjacent and generally parallel relationship. At least one and preferably at least two bolts 34 pass through openings in coupling plates 21, 31 and secure the plates together by suitable tensioned nuts 36. As may be apparent, any suitable fasteners may be substituted for bolts 34 and nuts 36. The provision of slots or elongated holes in one or both of coupling plates 21, 31 will permit the positioning of coupling plates 21, 31 relative to each other to be adjusted prior to securing nuts 36 in place. In preferred embodiment bi-fold door pin brace 10, adjusting slots 38 are provided in coupling plate 31 to permit the adjustment of the vertical displacement between shaft bracing plate 20 and header mounting plate 30. Header mounting plate 30 will preferably be provided with an easy, quick, and intuitive way to couple to the door header, ceiling, or the like. For this purpose, a plurality of fastener holes 32 have been formed entirely through header mounting plate 30. By elongating fastener holes 32, the position of header mounting plate 30 may be adjusted to properly align shaft bracing plate 20, so that a prior art guide pin traveling in the door track will move in such a way that the guide pin shaft will slide directly into shaft-receiving slots 24 when the bi-fold door is opened. Most preferably, at the time of installation, the pivot pin shaft will already be inserted into the distal shaft-receiving slot 24.

An optional central opening 23 may be provided within shaft bracing plate 20, primarily to provide access to the pivot bracket screw. An added benefit is reduced material requirement and finished weight. However, in some alternative embodiments central opening 23 is also be used to provide some resilience or cushioning when a door is fully opened with excessive force. In such alternative embodiments, the material selected for shaft bracing plate 20 must be at least sufficiently elastic or resilient to deflect repeatedly without consequential damage. A designer will select from a variety of spring metal compositions, plastic compositions, high durometer rubber compositions, and the like at the time of design to provide a desired resilience or cushioning effect.

Whether fabricated from metal, plastic, rubber, or other composition, a rim 26 may preferably be provided around the perimeter of shaft bracing plate 20. By shifting out of the plane of the majority of shaft bracing plate 20, rim 26 will provide significant structural rigidity. While not solely limiting the present invention thereto, as may be appreciated, both shaft bracing plate 20 and header mounting plate 30 as illustrated may be readily fabricated from sheet metal stock through highly cost-effective and efficient stamping and bending operations, thereby providing ready and low-cost fabrication with high structural integrity. In such case, rims 26, 28 may be formed as a part of the stamping operation. In alternative embodiments, as will also be appreciated each of these parts may be readily cast, molded, or otherwise fabricated.

In preferred embodiment bi-fold door pin brace 10, a pair of distally located bifurcated ends 22 are provided. These distal ends define the longitudinal axis of shaft bracing plate 20, and terminate in shaft-receiving slots 24 that will receive a guide pin shaft at one end, and a pivot pin shaft at the distal end. However, in some alternative embodiments only a single bifurcated end 22 will be used, in those instances where only one pin is required or desired to be braced.

Various embodiments of apparatus designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

First alternative embodiment bi-fold door pin brace 110, shown in FIGS. 4-7, illustrates an alternative embodiment that might, for exemplary and non-limiting purposes, be fabricated as a unitary part using an injection molding or casting fabrication technique. As a unitary part, there is no ability to adjust the spacing between shaft bracing plate 120 and header mounting plate 130. Instead, these plates are fixed together by coupling plate 131 and the reinforcing provided to coupling plate 131 through the combination of ribs 125 and ribs 135. The geometry of ribs 125, 135 has been selected to coincide with plastic and other polymeric materials, to best distribute forces encountered during use in a manner that will yield significant strength with a minimum of materials and weight. Nevertheless, in alternative embodiments other geometries are used, and in yet further alternative embodiments ribs 125, 135 are not used at all.

Figure 7:
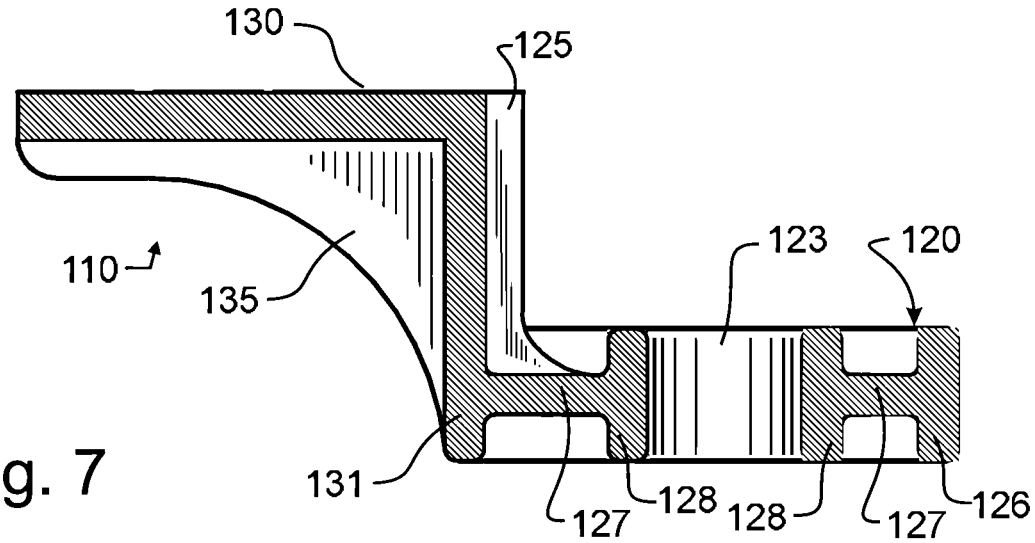
FIG. 7 illustrates the first alternative embodiment bi-fold door pin brace of FIG. 4 from a side elevational and sectional view taken along section line 7' of FIG. 4.
Figure 4:
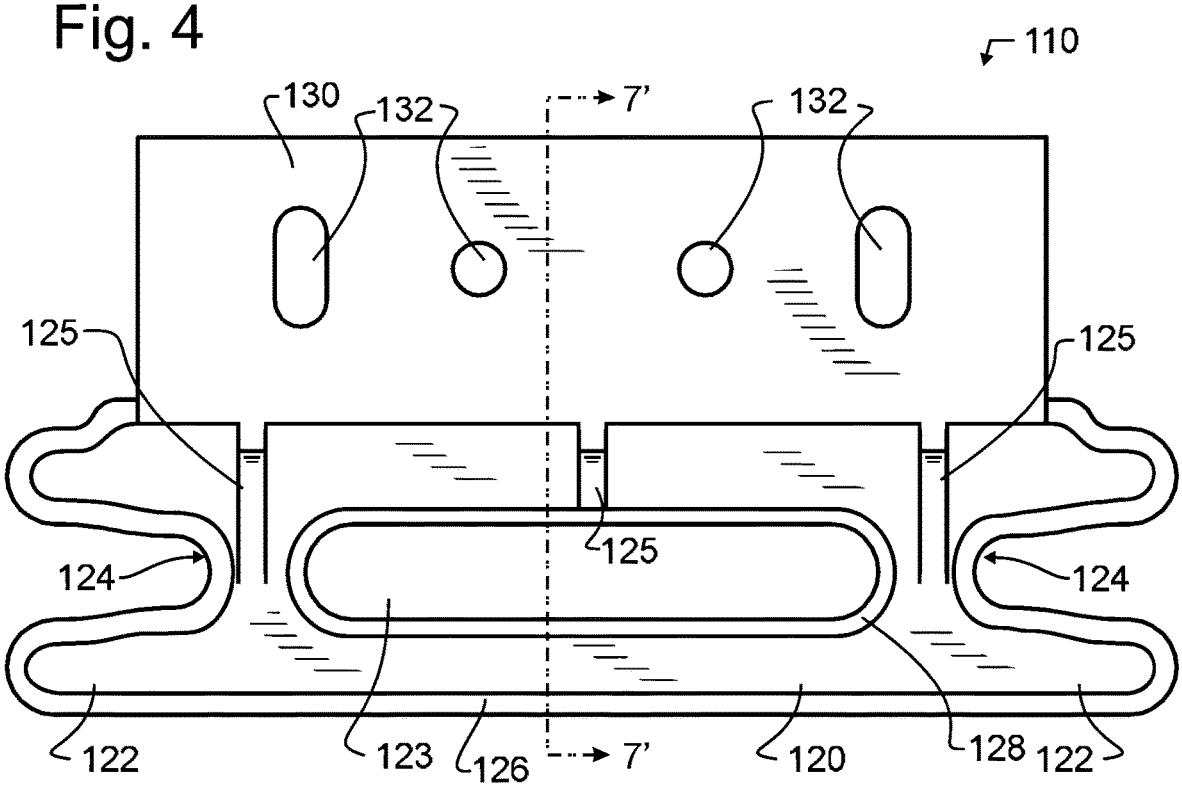
FIG. 4 illustrates a first alternative embodiment bi-fold door pin brace designed in accord with the teachings of the present invention from a top plan view.
Figure 5:
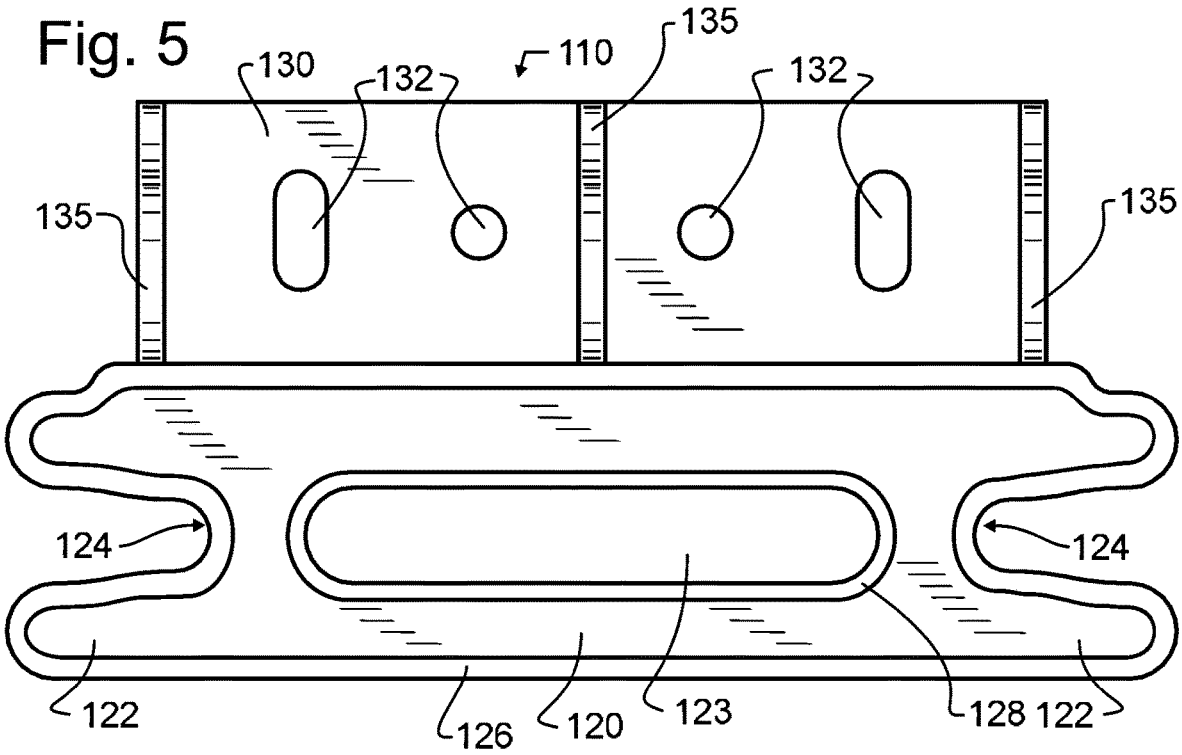
FIG. 5 illustrates the first alternative embodiment bi-fold door pin brace of FIG. 4 from a bottom plan view.

Reinforcing rims 126, 128 are much more pronounced in first alternative embodiment bi-fold door pin brace 110, and preferably in combination with web 127 form the well-known I-beam geometry best visible in FIG. 7 that also provides a substantial strength to weight ratio. Similar geometry is also visible in FIG. 7 in the combination of rim 128, webbing 127, and coupling plate 131. Also visible in FIG. 4 is an alternative embodiment set of four fastener holes 132 that include a combination of two slots and two round holes. The pair of elongated slots allow a pair of fasteners to be inserted therein, the first alternative embodiment bi-fold door pin brace 110 to be adjusted relative to a track and pins, and then the final position to be secured using the two round holes. In this manner, even in the event of the fasteners loosening, the round holes will keep first alternative embodiment bi-fold door pin brace 110 in fixed position relative to the track.

Second alternative embodiment bi-fold door pin brace 210 is illustrated in FIGS. 8-11. While sharing many of the features of the bi-fold door pin braces 10, 110, second alternative embodiment bi-fold door pin brace 210 may for exemplary purposes be formed as a unitary piece from sheet metal through cutting or stamping and bending operations. Coupling plate 231 is preferably smooth and linear, meaning the most forward face, closest to bifurcated ends 222 and shaft-receiving slots 224, can directly abut with a track along the entire surface, thereby providing maximum reinforcement to the track. This is best illustrated in FIGS. 10 and 11.

FIG. 10 shows second alternative embodiment bi-fold door pin brace 210 in position adjacent to bi-fold track 5. The shaft 8 of pivot pin 9 is shown as it would locate in one of shaft-receiving slots 224. The position of shaft 6 of guide pin 7 is shown in the position it would take with the bi-fold door in a fully open position. It can be seen that movement of door panels 1, 3 laterally to bi-fold track 5 would be constrained by second alternative embodiment bi-fold door pin brace 210 acting on the pin shafts 6, 8. In this FIG. 10, it can also be seen that the travel of the guide pin slide or wheel along track 5 will terminate when shaft 6 of guide pin 7 impacts the pin brace, rather than by the slider impacting a stop within the track.

FIG. 11 illustrates second alternative embodiment bi-fold door pin brace 210 combination with a track 5, pin assemblies 7, 9, and bi-fold door panels 1, 3, with bi-fold door panels 1, 3 in the most open position. Prior art guide pin assembly 7 and pivot pin assembly 9 are shown as they typically might be installed in the door panels. In this Figure, second alternative embodiment bi-fold door pin brace 210 is shown mounted to a doorway header with suitable fasteners such as Phillips head screws passing through fastener holes 232. The free exposed shafts of guide and pivot pins 7, 9 are braced, and constrained within shaft-receiving slots 224. With second alternative embodiment bi-fold door pin brace 210 secured in place, the door assembly will no longer lift for removal. This will, however, help to prevent accidental dislodgement of the bottom pivot pin from the bottom pivot bracket.

A third embodiment for fastener holes 232 is illustrated with second alternative embodiment bi-fold door pin brace 210, in this case using four round holes through which suitable anchoring fasteners will pass. Since coupling plate 231 will preferably be pressed directly against the track, there is no need for adjustment closer to or farther from the track. Nevertheless, if the track is of a dimension different from that for which second alternative embodiment bi-fold door pin brace 210 has been constructed, an installer will only have to slide one shaft receiving slot 224 around pivot pin shaft 8 protruding from prior art pivot pin assembly 9. Next, the installer will align coupling plate 231 generally parallel to prior art track 5, and then move prior art lead door panel 1 toward prior art pivot door panel 3 into the position illustrated in FIGS. 10 and 11 to capture guide pin shaft 6 protruding from prior art guide pin assembly 7 into the second shaft-receiving slot 224. Once done, the installer may insert suitable anchoring fasteners through fastener holes 232.

While FIGS. 10 and 11 specifically illustrate second alternative embodiment bi-fold door pin brace 210, it will be apparent that each of preferred embodiment bi-fold door pin brace 10 and first alternative embodiment bi-fold door pin brace 110 will preferably be installed in the same or similar position. As already noted herein above, preferred embodiment bi-fold door pin brace 10 is also height adjustable, and so from the position of FIG. 11, it may require appropriate height adjustment. While each of the bi-fold door pin braces 10, 110, 210 may be installed on either side of track 5, by installing them in the position illustrated in FIG. 11 they are essentially not visible from the outer side of the doors. In the case of a closet or the like, there will be no visible alteration to the look of the bi-fold doors.

FIG. 12 illustrates that some embodiments of a bi-fold door pin brace designed in accord with the teachings of the present invention are mounted to or coupled with other bi-fold door hardware. In this third alternative embodiment bi-fold door pin brace 310, a shaft bracing plate 320 has a primary geometry very similar to shaft bracing plate 120, including the cross-section illustrated in FIG. 7. A pair of distally located bifurcated ends 322 define shaft-receiving slots 324, into which guide and pivot pin shafts 6, 8 will be received and braced.

However, extending from the primary geometry are two coupling arms 321, that are configured to pass through a pair of coupling holes 331 in header mounting plate 330. Header mounting plate 330 is most preferably anchored to a door header, ceiling, or the like by passing appropriate anchoring fasteners through a set of fastener holes 332.

Header mounting plate 330 serves not only as a support and anchor for shaft bracing plate 320, but also as a bi-fold door stop as described in my co-pending U.S. patent application Ser. No. 15/592,169 filed May 10, 2017 and incorporated by reference herein above. The full nature and characteristics of that stop are disclosed fully and extensively in that patent application, but in brief summary the illustrated header mounting plate 330 provides additional and complementary protection for a bi-fold door against accidental harm and damage. Header mounting plate 330 prevents inward lateral movement of bi-fold door panels when the door is open, and provides a solid stop to the opening travel of the lead door panel. As a result, shaft bracing plate 320 only needs to constrain the pin shafts against lateral door panel movement in an outward direction. In addition, shaft bracing plate 320 is readily removed, to facilitate dismounting the door panel assembly. Consequently, the combination of the present shaft bracing plate 320 with header mounting plate 330 provides further benefit and synergy.

FIG. 13 shows a fourth alternative embodiment bi-fold door pin brace 410 mounted to a header mounting plate 430 of similar but slightly different geometry than that of header mounting plate 330. Many methods are known in the mechanical arts that are suitable for fastening shaft bracing plates 320, 420 to mounting plates 330, 430. However, in alternative embodiment bi-fold door pin braces 310, 410 they are most preferably held in installed position to their respective header mounting plates 330, 430 by the combination of coupling arms 321, 421 having dimension only slightly less than required to pass through coupling holes 331, 431, respectively, and a pair of bracing plate retention features 437, 439. Bracing plate retention features 437, 439 are visible in FIG. 13, and comprise a pair of slight protrusions. When shaft bracing plates 320, 420 are fully installed into their respective header mounting plates 330, 430, as illustrated in FIGS. 12 and 14, these bracing plate retention features 437, 439 will extend in a non-interfering manner into the space interior of rims 326, 426. However, to remove shaft bracing plates 320, 420 from their respective header mounting plates 330, 430, to the position illustrated in FIG. 13, the respective rims 326, 426 will engage with and must pass beyond these bracing plate retention features 437, 439. With properly sized and shaped bracing plate retention features 437, 439, there will be a distinct force greater than an accidental bump or vibration and that is instead indicative of intent to remove that is required to pull shaft bracing plates 320, 420 from their respective header mounting plates 330, 430.

Shaft bracing plate 420 differs from shaft bracing plate 320 in one notable feature. Instead of bifurcated ends 322 that define shaft-receiving slots 324, shaft bracing plate 420 has pin retaining ends 422 that are not bifurcated. Instead, since shaft bracing plate 420 is being used in combination with header mounting plate 430, shaft bracing plate 420 only needs to constrain the pin shafts against lateral door panel movement in an outward direction. Consequently, shaft bracing plate 420 also only needs to wrap around the outward side of the pin shafts. As already described herein above, header mounting plate 430 prevents inward lateral movement of bi-fold door panels when the door is open and provides a solid stop to the opening travel of the lead door panel.

In some instances it may be desirable to only capture the pivot pin and thereby prevent the pivot pin from lateral door panel movement in an outward direction. In such instances, modifications may be made to the preferred and alternative embodiment bi-fold door pin braces 10, 110, 210, 310, 410 to facilitate this capture. FIGS. 15-18 illustrate three different alternatives.

FIG. 15 illustrates a fifth alternative embodiment bi-fold door pin brace 510 that captures pivot pin shaft 8 using a shaft bracing plate 520 which resembles an open eye bolt and further has a swivel 527 and a nut 529 for securing to a suitable brace. As illustrated, shaft bracing plate 520 is secured to a header mounting plate 530. Header mounting plate 530 is illustrated in section view with the top removed to reveal additional features, but is of similar construction and function to header mounting plates 310, 410. While shaft bracing plate 520 and header mounting plate 530 are preferred, in some alternative embodiments an open eye bolt, or j-bolt, or will be secured to a bracket or other hardware in a similar manner.

FIG. 16 illustrates sixth alternative embodiment bi-fold door pin brace 610 that captures pivot pin shaft 8 using shaft bracing band 620 secured by a post 640 mounted on a header mounting plate 630 of similar construction and function to header mounting plates 310, 410. In some embodiments, shaft bracing band 620 is of fixed length, with adjustments to tension made by moving post 640. In alternative embodiments, the length of shaft bracing band 620 is adjustable. Other embodiments may use various methods of adjusting the band length, and the band may be made of plastic, metal, or other materials. Post 640 may be attached to, be a part of, or be independent of header mounting plate 630.

FIGS. 17 and 18 illustrate seventh alternative embodiment bi-fold door pin brace 710 that captures pivot pin shaft 8 using a shaft bracing plate 720 that has the configuration of a strap formed into a hook shape. Shaft bracing plate 720 is mounted on a header mounting plate 730 of similar construction and function to header mounting plates 310, 410. Alternative embodiments will use other shapes, lengths, materials, and profiles of arms to capture pivot pin shaft 8. It is preferable that shaft bracing plate 720 is easily removable to facilitate door removal. The profile of shaft bracing plate 720 shown in this embodiment maximizes bracing of pivot pin shaft 8 during proper and improper door panel movement. The profile of shaft bracing plate 720 in this embodiment captures as substantial portion of the exposed pin shaft, preventing the door lifting, so preventing the bottom pivot pin moving within, or coming out of the bottom pivot bracket.

FIG. 18 illustrates one way to secure shaft bracing plate 720 to header mounting plate 730, for exemplary and non-limiting purpose using a linear ratchet apparatus comprising a series of teeth or bulges 727 adapted to press with much resistance through coupling hole 731. In alternative embodiments, clips, set screws, or other methods are used to retain shaft bracing plate 720 in position. The retaining mechanism may be part of other hardware, or an independent bracket.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, a bi-fold door and a bi-fold door pin brace operative to safely limit the movement of said bi-fold door, said bi-fold door having:

a header;

a bi-fold door track mounted to said header;

a lead door;

a guide pin affixed to said lead door and configured to slide within said bi-fold door track;

a pivot door;

a pivot pin anchored with respect to said bi-fold door track and affixed to said pivot door; and a hinge coupling said lead door to said pivot door;

said bi-fold door pin brace having:

a header mounting plate generally defining a first generally planar surface affixed to and anchored by said header independent from said bi-fold door track;

a coupling plate extending from said header mounting plate in a plane angularly offset from said first generally planar surface and exterior to said bi-fold door track; and a bi-fold pin shaft bracing plate defining a third generally planar surface extending from said coupling plate in a plane offset from said coupling plate plane and generally parallel to said header mounting plate first generally planar surface, said bi-fold pin shaft bracing plate third generally planar surface located between a bottom of said bi-fold door track and a top of said pivot door, said bi-fold pin shaft bracing plate configured to engage with and provide support to a shaft of at least one of said bi-fold door guide pin and said bi-fold door pivot pin.

2. The combination bi-fold door and bi-fold door pin brace of claim 1, wherein said coupling plate is abutted against said bi-fold door track.

3. The combination bi-fold door and bi-fold door pin brace of claim 2, wherein said coupling plate is generally perpendicular to said header mounting plate first generally planar surface.

4. The combination bi-fold door and bi-fold door pin brace of claim 1, wherein said coupling plate further comprises:

a first coupler rigidly affixed with said shaft bracing plate;

a second coupler rigidly affixed with said header mounting plate; and an adjustable fastener securing said first coupler to said second coupler in a first fastened configuration, and allowing said first coupler to move relative to said second coupler in a second released configuration;

said first coupler, said second coupler, and said adjustable fastener configured to vary a distance between said shaft bracing plate and said header mounting plate when said adjustable fastener is in said second released configuration, and to prevent relative movement between said shaft bracing plate and said header mounting plate when said adjustable fastener is in said first fastened configuration.

5. The combination bi-fold door and bi-fold door pin brace of claim 1, wherein said bi-fold pin shaft bracing plate further comprises a first bifurcated end defining a first bi-fold pin shaft receiving slot.

6. The combination bi-fold door and bi-fold door pin brace of claim 5, wherein said bi-fold pin shaft bracing plate further comprises a second bifurcated end defining a second bi-fold pin shaft receiving slot, said second bifurcated end separated from and distal to said first bifurcated end along a bi-fold pin shaft bracing plate longitudinal axis.

7. The combination bi-fold door and bi-fold door pin brace of claim 1, wherein said bi-fold pin shaft bracing plate further comprises a perimeter encompassing rim adapted to reinforce said bi-fold pin shaft bracing plate.

8. The combination bi-fold door and bi-fold door pin brace of claim 1, wherein at least one of said lead door and said pivot door further comprises a door stile; and wherein said header mounting plate further comprises a bi-fold door stop, said bi-fold door stop having:

a first bi-fold door stile stop configured to engage with and thereby limit travel of said door stile in a first travel direction; and a second bi-fold door stile stop configured to engage with and thereby limit travel of said door stile in a second travel direction generally perpendicular to said first travel direction.

9. The combination bi-fold door and bi-fold door pin brace of claim 1, wherein said bi-fold pin shaft bracing plate is configured to engage with and provide support to a shaft of said bi-fold door pivot pin within a space between said bi-fold door track and said pivot door.

10. The combination bi-fold door and bi-fold door pin brace of claim 9, wherein said bi-fold pin shaft bracing plate configured to engage with and provide support to a shaft of said bi-fold door guide pin within a space between said bi-fold door track and said lead door when said bi-fold door is in an open position.

11. The combination bi-fold door and bi-fold door pin brace of claim 1, wherein said bi-fold pin shaft bracing plate configured to engage with and provide support to a shaft of said bi-fold door guide pin within a space between said bi-fold door track and said lead door when said bi-fold door is in an open position.

12. The combination bi-fold door and bi-fold door pin brace of claim 5, wherein said first bi-fold pin shaft receiving slot is configured to engage with and provide support to a shaft of said bi-fold door pivot pin within a space between said bi-fold door track and said pivot door.

13. The combination bi-fold door and bi-fold door pin brace of claim 12, wherein said second bi-fold pin shaft receiving slot is configured to engage with and provide support to a shaft of said bi-fold door guide pin within a space between said bi-fold door track and said lead door when said bi-fold door is in an open position.

14. The combination bi-fold door and bi-fold door pin brace of claim 5, wherein said first bi-fold pin shaft receiving slot is configured to engage with and provide support to a shaft of said bi-fold door guide pin within a space between said bi-fold door track and said lead door when said bi-fold door is in an open position.

* * * * *